United States Patent [19]

Estingoy

[11] 4,369,638

[45] Jan. 25, 1983

[54] METHOD AND APPARATUS FOR KNITTING HOLLOW ARTICLES

[76] Inventor: Henri L. Estingoy, 104 rue Navarrot, Oloron-Ste. Marie, France, 64400

[21] Appl. No.: 201,169

[22] Filed: Oct. 27, 1980

Related U.S. Application Data

[63] Continuation-in-part of Ser. No. 960,163, Nov. 13, 1978, abandoned.

[30] Foreign Application Priority Data

Nov. 17, 1977 [FR] France ..... 77 34610

[51] Int. Cl.[3] ..... D04B 9/40

[52] U.S. Cl. ..... 66/148

[58] Field of Search ..... 66/147, 148, 96 W

[56] References Cited

U.S. PATENT DOCUMENTS

| | | | |
|---|---|---|---|
| 2,827,781 | 3/1958 | Lambach | 66/90 W |
| 3,304,749 | 2/1967 | Stouhase | 66/147 |
| 3,349,576 | 10/1967 | Borne | 66/148 |
| 3,446,042 | 5/1969 | Fontaine | 66/148 |
| 3,514,978 | 6/1970 | Buederhauser | 66/148 |
| 3,563,063 | 2/1971 | Blood et al. | 66/148 |
| 3,633,385 | 1/1972 | Bruelemans | 66/148 |
| 3,677,037 | 7/1972 | Krause | 66/147 |
| 3,913,358 | 10/1975 | Dhondt | 66/148 |

FOREIGN PATENT DOCUMENTS

| | | | |
|---|---|---|---|
| 2223493 | 10/1974 | France | 66/148 X |

*Primary Examiner*—Ronald Feldbaum
*Attorney, Agent, or Firm*—Bacon & Thomas

[57] ABSTRACT

A method and apparatus for manufacturing hollow knitted articles, particularly berets and other headgear, which method consists in first knitting a piece having an equal number of loops on its two ends using at least some of the needles in one bed of the knitting machine and then joining the two ends together. A first row of loops forming the one end of the piece are transferred to a support located underneath the needle bed while the remainder of the piece is knitted so the knitting is folded with its finished side on the inside. The loops on the other end are then transferred to a common support with the corresponding loops from the one end and the two ends are joined together by sewing.

The method and apparatus enable the operation to be carried out entirely automatically.

9 Claims, 36 Drawing Figures fig. 3f
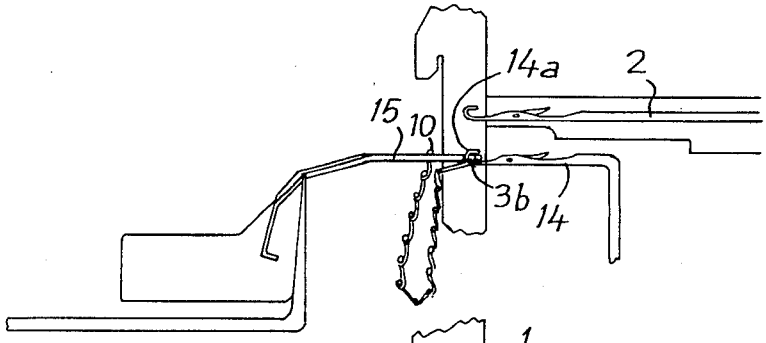
fig. 3g
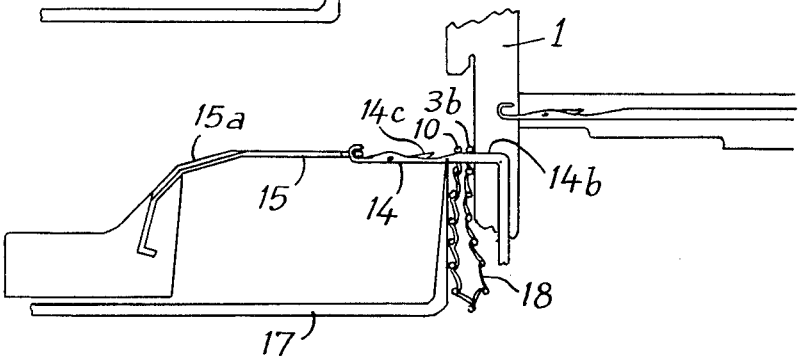
fig. 3h
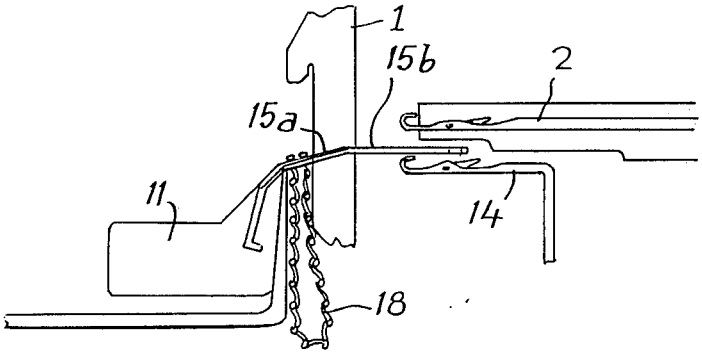
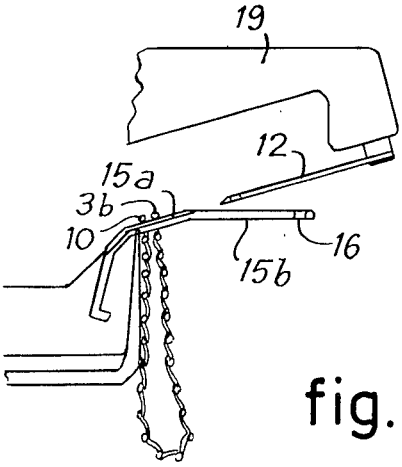
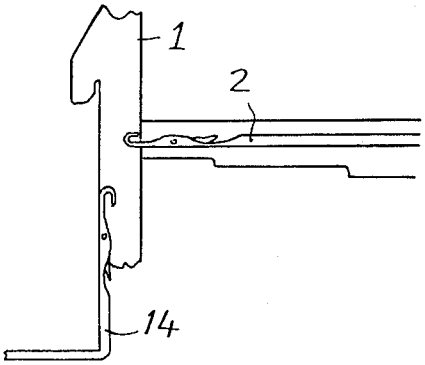
fig. 3i

METHOD AND APPARATUS FOR KNITTING HOLLOW ARTICLES

This is a continuation-in-part of application Ser. No. 960,163, filed Nov. 13, 1978, now abandoned.

The present invention relates to a method of manufacturing a hollow knitted article by knitting a flat piece having an equal number of loops on its two ends using at least some of the needles in one bed of a knitting machine such as a straight bar machine, and then transferring the loops from one edge and the corresponding loops from the other edge onto a support called the assembly support where they are joined together in pairs by sewing while still in the knitting machine. The invention is also concerned with a knitting machine which enables the carrying out of this method.

The invention may be applied to the manufacture of any knitted article in which two ends are joined and it is particularly applicable to the knitting of berets and other headgear.

At present, the sewing together of the two ends is carried out on a stitcher which is separate from the knitting machine and which involves considerable manual labour to carry out the mounting of the two ends stitch by stitch on the points of the sewing machine.

This invention eliminates this disadvantage and its object is to provide a method which enables the automation of the mounting of the loops on the points of the stitcher.

In accordance with one aspect of this invention, a method of manufacturing knit goods such as a hollow knitted article by knitting a piece having an equal number of loops on its two ends using at least some of the needles in one bed of a knitting machine and then joining the two ends together comprises forming a first row of loops forming the one end, transferring the loops forming the one end onto a support located closely underneath and substantially in vertical alignment with the front end of the needles in the needle bed in their knocking over position, continuing the knitting of the piece whilst keeping the first row on the support until the knitting of the piece is completed, so that the knitting is folded with its right or finish side on the inside and, upon completion of the knitting, transferring each of the loops from the other end onto a common support with the corresponding loop from the one end, and joining the loops together by sewing.

Preferably the article is a weft knitted article and the first row of loops is formed and transferred to the support by seizing and retaining loops of thread formed between the needles in the needle bed and retaining these loops in position on the support whilst the first row is completed.

Preferably the loops forming the one end are retained on a temporary support and the loops forming the other end are retained on a primary support, the loops forming the one end being transferred from the temporary support to the primary support. In this case it is further preferred that the loops forming the other end of the piece are initially transferred on to the primary support while the loops forming the one end of the article are transferred from the temporary support to the primary support afterwards.

In accordance with another aspect of this invention, a knitting machine capable of carrying out the method comprises one flat needle bed, means to advance and retract the needles of the needle bed, means to lay thread over the needles of the needle bed, a set of hooks which are arranged under the needle bed and offset from the needles of the needle bed so that the hooks are located beneath and in between adjacent needles of the needle bed, the hooks being connected to driving means arranged in such a way that each hook is moved to seize a loop of the first row of thread formed between the needles of the needle bed and then retain the loops beneath the needle bed whilst the needle bed is used to knit the piece. A set of transfer and assembly points is connected to driving means controlled by a programmer synchronised with the motion of the machine, and a sewing station is provided including automatic sewing means. The set of transfer and assembly points are arranged so that at the end of the knitting period the points are advanced towards the needle bed to engage the loops of the last row of the knit piece on the needles of the needle bed and to receive such loops as the needles are retracted. The points then engage the loops forming the first row of the knitting and move away from the needle bed and hooks to the sewing station, where the loops of the two ends of the knitting are joined together by sewing the loops together on the transfer and assembly points.

Preferably the needles of the needle bed are of the latch-needle type and the hooks for holding the one end of the knitting are identical latch-needles.

Preferably each transfer and assembly point includes an elongate member having an elongated hole at its free end of length greater than that of the hook of the needles in the needle bed and of a width greater than the width of the needles of the needle bed and, includes a grooved section behind the elongate hole, the profile of the groove being such as to allow the needle of the automatic sewing means to pass along the groove and under loops located on the transfer and assembly points.

Two examples of a machine in accordance with this invention will now be described with reference to the accompanying drawings, in which:

FIGS. 1*a* to 1*o* are schematic cross-sections through the needle bed of the knitting machine and illustrate the sequence of operations of the first example;

FIGS. 2*a* to 2*c* are schematic perspective views of part of the needle bed of the first example;

FIGS. 3*a* to 3*i* are schematic side elevations of the needle bed and illustrate the operation of the second example;

FIG. 4 is a schematic perspective view of part of the transfer and assembly points of the second example; and, FIG. 5 is a block diagram schematically showing the operation of the knitting machine;

FIG. 6 schematically shows the mechanism for carrying out the process of FIGS. 3*a* to 3*i;*

To allow a better comprehension of the advantages of the invention, the manufacture of the berets according to the prior art will first be recalled.

With reference first to FIGS. 9–12, the berets 100 are formed from a sector 101 which is worked into shape and the large edges of which are joined by a seem 102 so as to constitute a beret provided with a tail 103.

Figure 11:
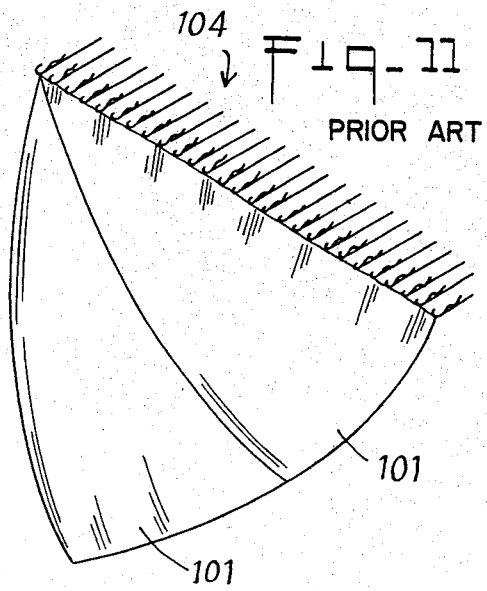
Fig. 11 PRIOR ART
FIG. 11 shows one phase of the manufacture of a beret according to the prior art.

According to the prior art, the sectors designed to form the berets, are produced one after the other (FIG. 11); they are separated, then each sector is assembled by hand edge-to-edge to produce the seem 102. FIG. 11 schematically shows the flat needle bed 104 and the successive sectors 101 being made-up.

Figure 12:
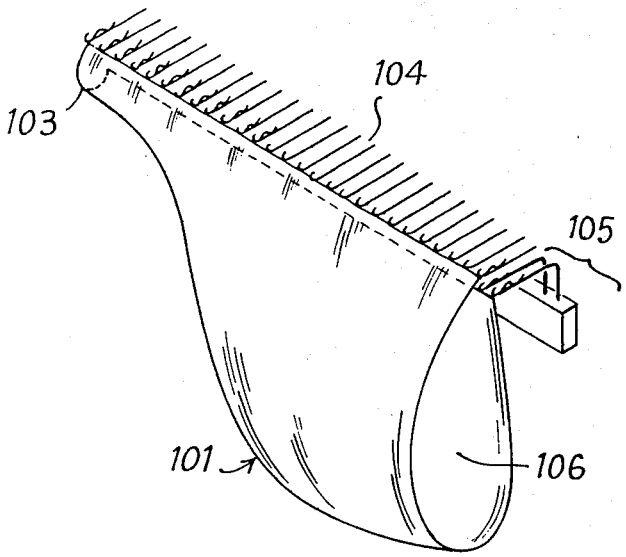
FIG. 12 shows one phase of the manufacture of a beret according to the invention.

FIG. 12 illustrates the principle of the invention which consists in holding the first row of loops of one sector 101 on a first support 105 and in bringing the said first row of loops beneath the needle bed 104 so that in continuing the knitting, the knit sector 101 has to fold up finish side on finish side; in other words, the finish side 106 of the knit piece is found to be inside the fold made by the knit piece.

It is important for the first support to be placed as close as possible beneath the needle bed so that a tail 103 of small diameter can be made or a central hole as small as possible.

The method and device according to the invention will now be explained in detail.

Both examples are based on a straight-bar knitting machine having a single row of latch needles.

Figure 1A:
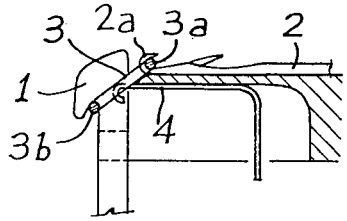
Figure 2A:
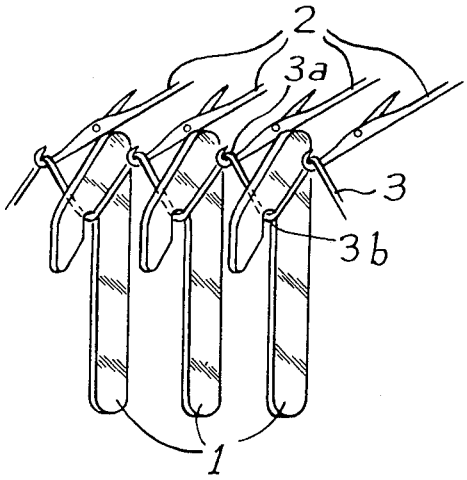
Figure 2B:
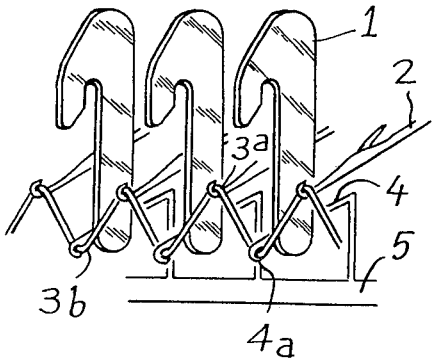

The first example, described in FIGS. 1*a* to 1*o* and 2*a* to 2*c*, is a machine in which the loops are drawn in a conventional way by vertically movable sinkers 1. The latch needles 2 are moved forwards and backwards (left and right in the drawings) by means of a conventional cam provided on a carriage, and by a blade respectively, in a conventional manner. The stitch that is obtained from such a machine is of the stocking type. As shown in FIGS. 1*a* and 2*a* the first laid thread 3 is festooned by lowering the sinkers 1 so as to form a zig-zag loop 3*a* over each needle 2.

Figure 1B:
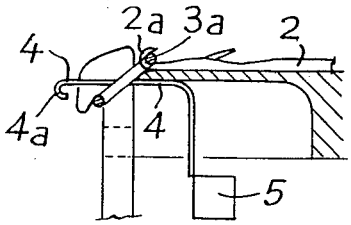
Figure 1C:
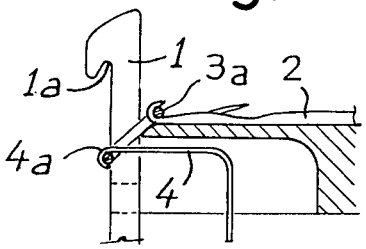

Hooked points 4 fixed to a common bar 5 are advanced towards needles as shown in FIG. 1*b* and lowered to catch the thread 3 (FIGS. 1*c* and 2*b*) at each downward loop between each pair of adjacent needles 2, and bring it backwards against the side of the sinkers 1.

Figure 1D:
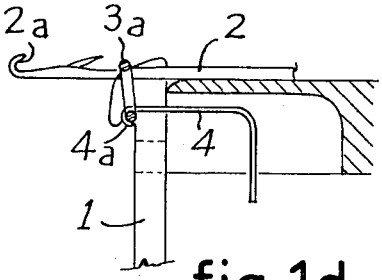
Figure 1E:
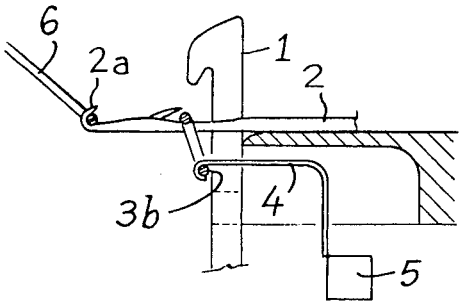
Figure 1F:
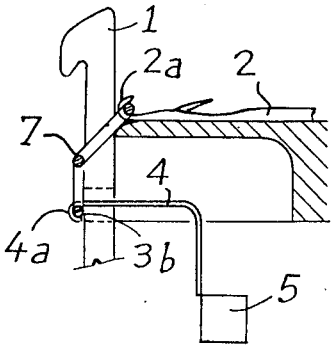
Figure 1G:
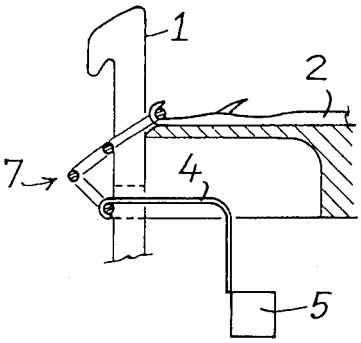
Figure 1H:
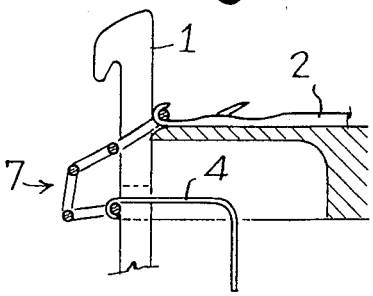

The needles 2 are moved forward as shown in FIG. 1*d*, and then another thread 6 is gathered as shown in FIG. 1*e*. FIGS. 1*f* and 2*c* show the first row 7 of loops formed after the knocking over operation. The hooks 4 thus hold the loops of the first end of the knitted piece near the needle bed and allow the formation of the first loop heads 3*b* as the needles 2 move forward. After the knocking over operation on the first row, the bar 5 and the hooks 4 descend as shown in FIG. 1*f* and remains in this position until the knitting of the article has been completed. The loop 4*a* of the hook 4 in its lowered position is below the lowermost position of the groove 1*a* in the hook of the sinkers 1, as shown in FIG. 1*d*, for example, and substantially in vertical alignment with the hook 2*a* of the needles 2 in their knocking over position (FIGS. 1*f* to 1*i*).

Figure 1I:
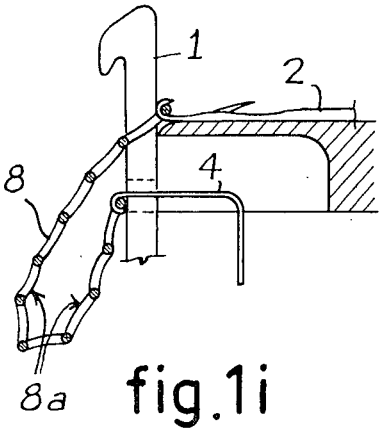
Figure 2C:
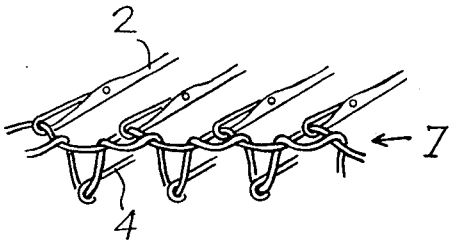

As further rows of loops are formed with the fabric being knitted in stocking stitch, the knitted fabric folds at 8 as shown in FIG. 1*i* so that the right or finish sides 8*a* are located on the inside of the fold.

Figure 1J:
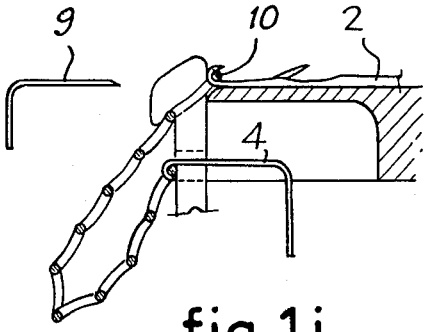
Figure 1K:
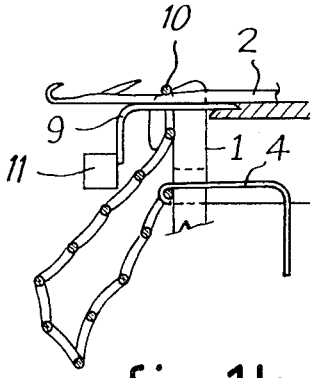
Figure 1L:
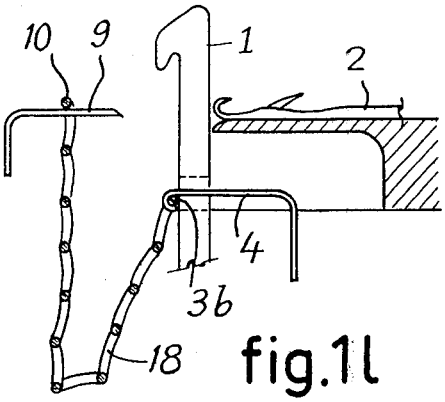
Figure 1M:
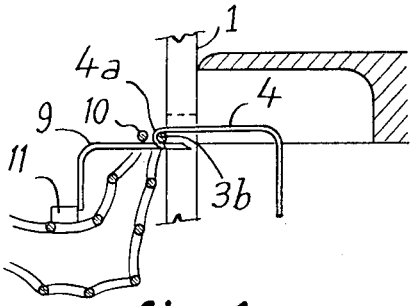
Figure 1N:
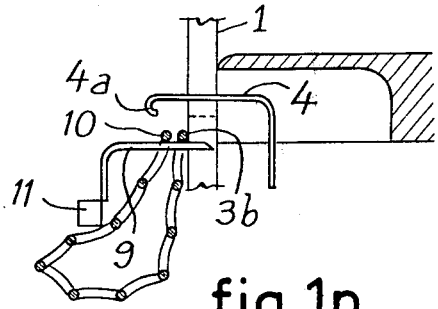
Figure 1O:
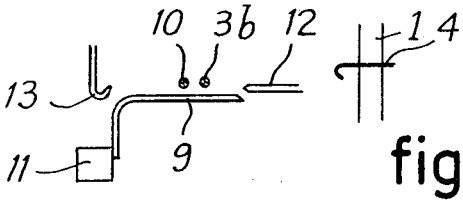

Once the knitting of the piece which is to form the article is completed the supply of thread is stopped. The other end of the knitting is formed by the loops heads 10 held by the needles 2. These loops are gathered by the points 9 fixed to a common bar 11 to form a "bar with points", that is used to support the knit article for sewing of the end loops. The points 9 are arranged at the same spacing as the needles 2 and are brought up to their corresponding needles 2 (FIG. 1*j*) and engaged in the loop head 10 lying on this needle (FIG. 1*k*). Upon the backwards motion of the needles 2 the loop heads are left on their corresponding points 9. The latter are then moved away from the needles 2 (FIG. 1*k*), lowered and moved forward to engage the loop heads 3*b* held by the hooks 4 (FIG. 1*m*). The hooks 4 are then advanced and raised so that their loops 4*a* disengage from the loops 3*b* (FIG. 1*n*) and the hooks then return to their initial position as shown in FIG. 1*a*.

The two ends of the knitted piece are then automatically sewn stitch by stitch finish side to finish side on the points 9. The movements of the hooks 4 and the bar 5 and the points 9 and the bar 11 are controlled in synchronism with the motion control means of the machine by way of a mechanical or electronic programmer, such as a cam programmer.

The points 9 are constructed in a conventional manner, with a longitudinal groove in their upper face which enables a stitching needle 12 to pass through the groove and through the loops of loop heads 10 and 3*b*. The needle 12 forms part of a sewing station, of which only the needle 12 and the hook 13 have been represented in FIG. 1*o*.

The operation of the sewing station 12, 13 is also controlled in synchronism with the motion of the machine and it operates when the bar 11 is located in a predetermined position at a certain distance from the needles 2. The knitting of the next piece resumes as soon as the operation of the sewing station begins.

Figure 3A:
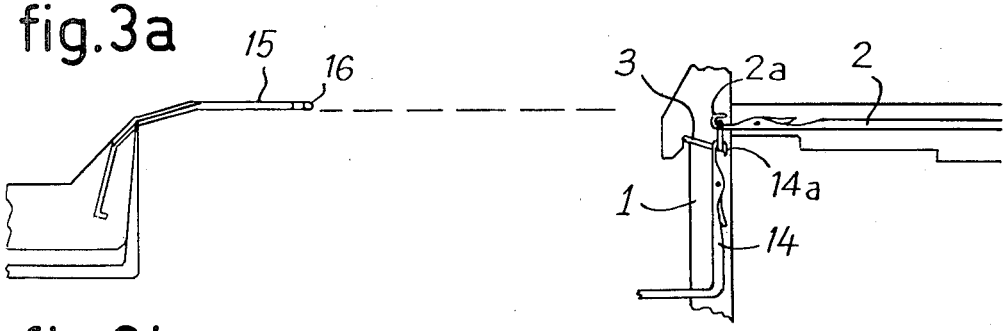
Figure 3B:
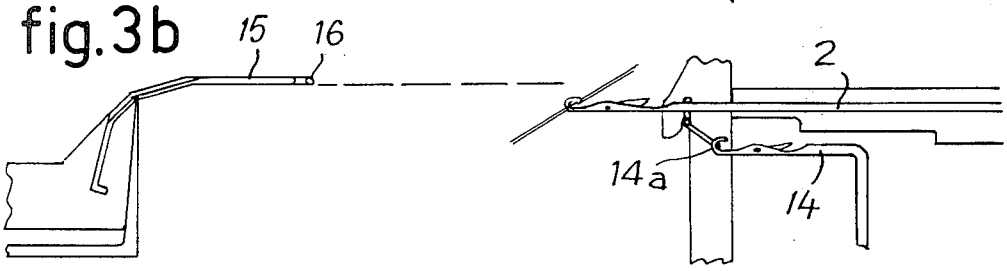
Figure 3C:
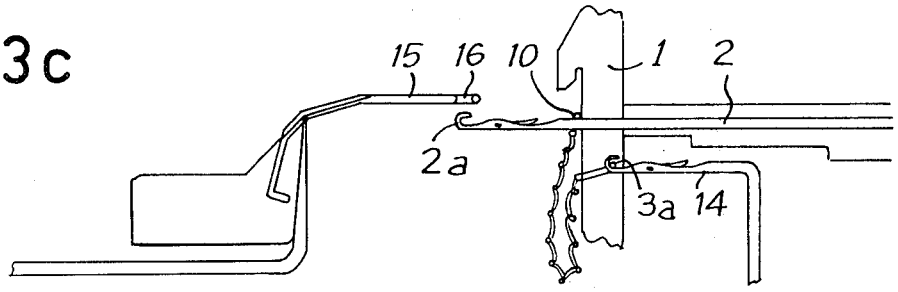
Figure 3D:
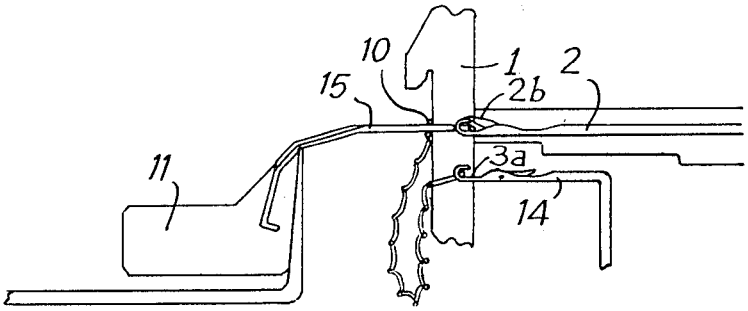
Figure 3E:
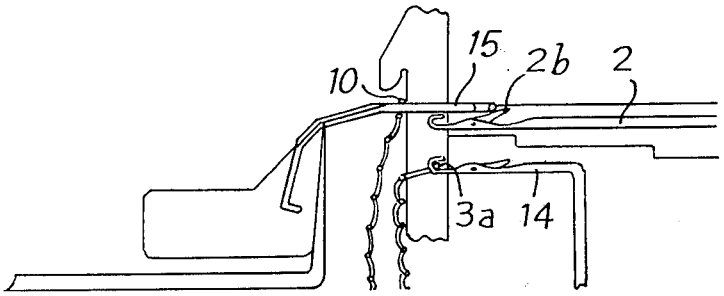
Figure 4:
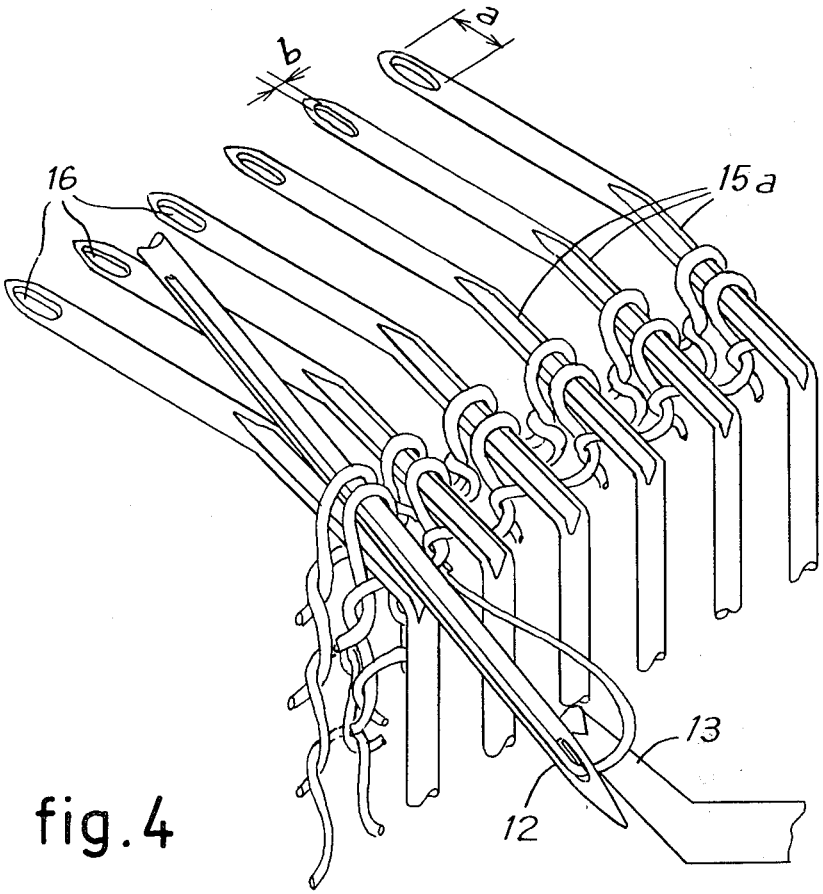

FIGS. 3*a* to 3*i* show the second example and in this example the simple hooks 4 are replaced by latch needles to be referred as temporary retention latch needles 14 and the simple points 9 are replaced by complex points 15 which include an eye 16 at their free end, the eye 16 having an elongated shape in the axial direction of the points 15. The axial length "a" of each eye 16 is slightly greater than that of the hook 2*a* and the width "b" of this eye 16 is slightly greater than the thickness of the hook 2*a* as shown in FIG. 4. With these characteristics each point 15 gathers the loop head 10 lying on the corresponding knitting needle 2 and the loop head 3*b* lying on the temporary retention latch needle 14, in the following manner. Firstly the points 15 advance towards their corresponding needles 2 until their eyes 16 lie over and are in alignment with the hook 2*a* of the needles (FIG. 3*c*). The points 15 then descend so that the hooks 2*a* are engaged in the eyes 16. Then the points advance again along the sliding axis of the needles 2, moving the needles 2 backwards along with them in their motion, so that the loop heads 10 from the needles pass over the points 15 with the cooperation of the sinkers 1 (FIG. 3*d*). Towards the end of the travel of advance the points 15 are raised and on completing their advance push the latches 2*b* of the needles 2 into their open positions (FIG. 3*e*).

The gathering by the points 15 of the earlier knit loops 3*b* lying on the corresponding temporary retention latch needles 14 is then carried out as follows. The hooks 14*a* of the needles 14 are first of all engaged in the eyes 16 of the points 15 (FIG. 3*f*). Then the points 15 move back taking with them the needles 14; at the same time a counter sinker 17 is pushed back towards the needle bed to hold the knitted piece 18 against the sides of the sinkers 1 so that the loop heads 10 and 3*b* are temporarily transferred onto portions 14*b* of the needles 14 located behind the latches 14*c* of the needles 14 (FIG. 3*g*).

The points 15 are then advanced in the direction of the needle bed to receive the loop heads 10, 3*b* which are held between the sinkers 1 and the counter sinker 17 (FIG. 3*h*). The points 15 advance sufficiently for the loops heads 3*b*, 10 to pass over an axially grooved portion 15*a* of the points 15. These portions 15*a* are located behind the eyes 16 of the points and the points may be straight and arranged horizontally or else bent with the portions 15*a* inclined as shown. The transverse profile of this grooved portion is arranged to match the type of needle used for sewing; in the second example this profile has the form of a V-shaped groove.

When the points 15 include inclined portions 15*a* as shown by FIG. 3*i*, the slope of the grooved portions 15*a* with respect to the horizontal end portions 15*b* of the points 15 enables a correspondingly inclined arrangement of the needle 12 of the sewing station, the arm 19 of which is partially shown in FIG. 3*i*.

As shown in FIGS. 3*d*, 3*e* and 3*h* the needles 2 or 14 are capable of movement backwards as far as an extreme position of withdrawal in which the needles 2, 14 are in abutment with a stop.

The needles 14 are arranged vertically at the time when they are engaging the thread 3 initially on the needles 2 as shown in FIG. 3*a*, and they are then brought into the horizontal position as shown in FIG. 3*b* after the first row of knitting has been completed by the knocking over operation. The hooks 4 in the first example may be arranged to operate in a similar fashion.

Figure 6:
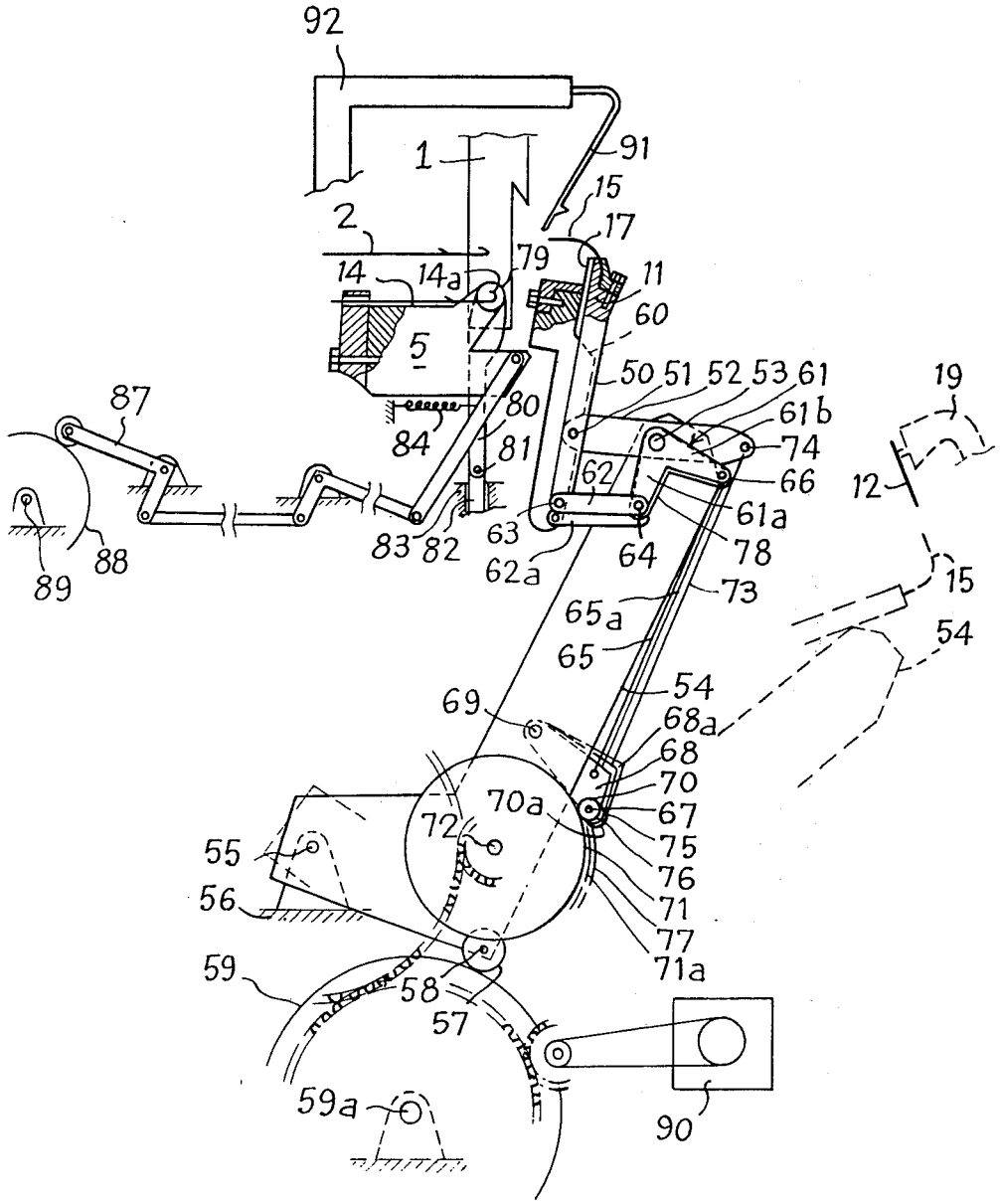

FIG. 6 shows an example of control device for generating the movements illustrated in FIGS. 3*a* to 3*i* of the present patent application.

In FIG. 6, which is a schematic elevation of the control device, the bar 11 with points 15 is constituted by the upper end of a two-arm lever 50 hinged at 51 on one end of a two-arm lever 52, itself hinged at 53 on the upper end of a bell crank lever 54 of larger dimensions than the two preceding levers 50 and 52. The lever 54 pivots about a fixed axis 55 on the frame 56 of the machine and its pivoting movement about said axis 55 is controlled by a cam follower 57 pivoting about an axis 58 journalled in the crank of the lever 54, the cam follower 57 following the surface of a cam 59 revolving on a rotary shaft 59*a* journalled in the frame 56.

The counter sinker 17 is fitted on the upper end of a two-arm lever 60 which is hinged on the same axle 51 as the lever 50, on the lever 52.

A two-arm bell crank lever 61 is hinged, on the axle 53, on the pivoting lever 54. A connecting rod 62 is hinged, on the one hand, in 63 on the lower end of the lever 50 and, on the other hand, in 64, on the free end of one of the arms (61*a*) of the bell crank lever 61.

A connecting rod 65 is hinged at 66 on the free end of the other arm 61*b* of the bell crank lever 61 and is hinged at its other end at 67, on a lever 68 pivoting freely on an idle shaft 69 mounted on the lever 54, the pivoting movement of the lever 68 being controlled by a cam follower 70 which follows the surface of a cam 71, keyed on a shaft 72 mounted for rotation on the lever 54, the thrust of the cam 71 acting on the lever 68 against a return spring not shown. The elements 61*a*, 62, 50 and 52 are arranged so as to form a deformable parallelogram. The lever 52 is pivoted about the axle 53 by means of a connecting rod 73, one end of which is hinged in 74 on the end of the lever 52 which is opposite the axle 51, the other end being hinged on a pivoting lever 75 keyed on the shaft 69, and the pivoting movement of which is ensured by a cam follower 76 journalled on the lever 75 and following a cam 77 keyed on the shaft 72.

The cam 77 is associated to a counter-cam not shown, keyed on the same shaft 72, and on the surface of which runs the cam follower of a pivoting counter-lever keyed on the shaft 69 and consequently fast with the lever 75, so that it is the cam and its counter-cam which control respectively the pivoting movement of the lever 52 in one direction and in the other.

To control the counter-sinker 17 by the pivoting movement of the lever 60 about the axle 51, means are provided which are identical to those which control the bar 11 with points 15, namely: a bell crank lever 78, identical to the lever 61, of which one arm is joined via a connecting rod 62*a* to the lever 60, while the other arm is joined via a connecting rod 65*a* to a lever 68*a* pivoting freely on the shaft 69 and rotating due to the thrust of a cam follower 70*a* following the surface of a cam 71*a* keyed on the shaft 72, the cam 71*a* pushing the lever 68*a* against the action of a return spring not shown.

The rotation of the shaft 72 driving the cams 71, 71*a* and 77, as well as the rotation of the shaft 59*a* driving the cam 59, are ensured by a motor 90 which transmits its rotary movement to the shafts by a system of belts, pulleys and pinions.

The bar 5 which supports the latch needles 14 having hooked points 14*a* is mounted to pivot about a horizontal axle 79 which is itself mounted on the upper end of a support 80, in semi-hinged manner in 81, on a support 82 vertically guided in slides 83 provided on the frame 56. A spring 84 is provided to return the support 80 to a vertical position, in the absence of other forces. Said bar 5 can be pivoted about the axis 79 by means of a system 85 of connecting rods and levers, the movement of which is controlled by a bell crank lever 87 whose rotation is caused by the thrust of a cam 88 keyed on a shaft 89.

The support 82 may be moved vertically over a short length by way of a system of connecting rods and levers not shown, controlled by a second cam keyed on the shaft 89. The rotation of the shaft 89 is controlled by a mechanism depending on the motor which ensures the movement of the knitting device, and only occurs during the first four passages of the thread guide.

The upper part of the knitting device is of the single straight bar machine type, identical to that used conventionally for knitting berets and other headgears. It must be noted that the knitting or articles of which the wales of stitches are not of the same length does not permit the drawing of the knitting and then grippers or sinkers are used (such as in the present application) to allow the knitting. This system is driven conventionally by a motor not shown.

Figure 5:
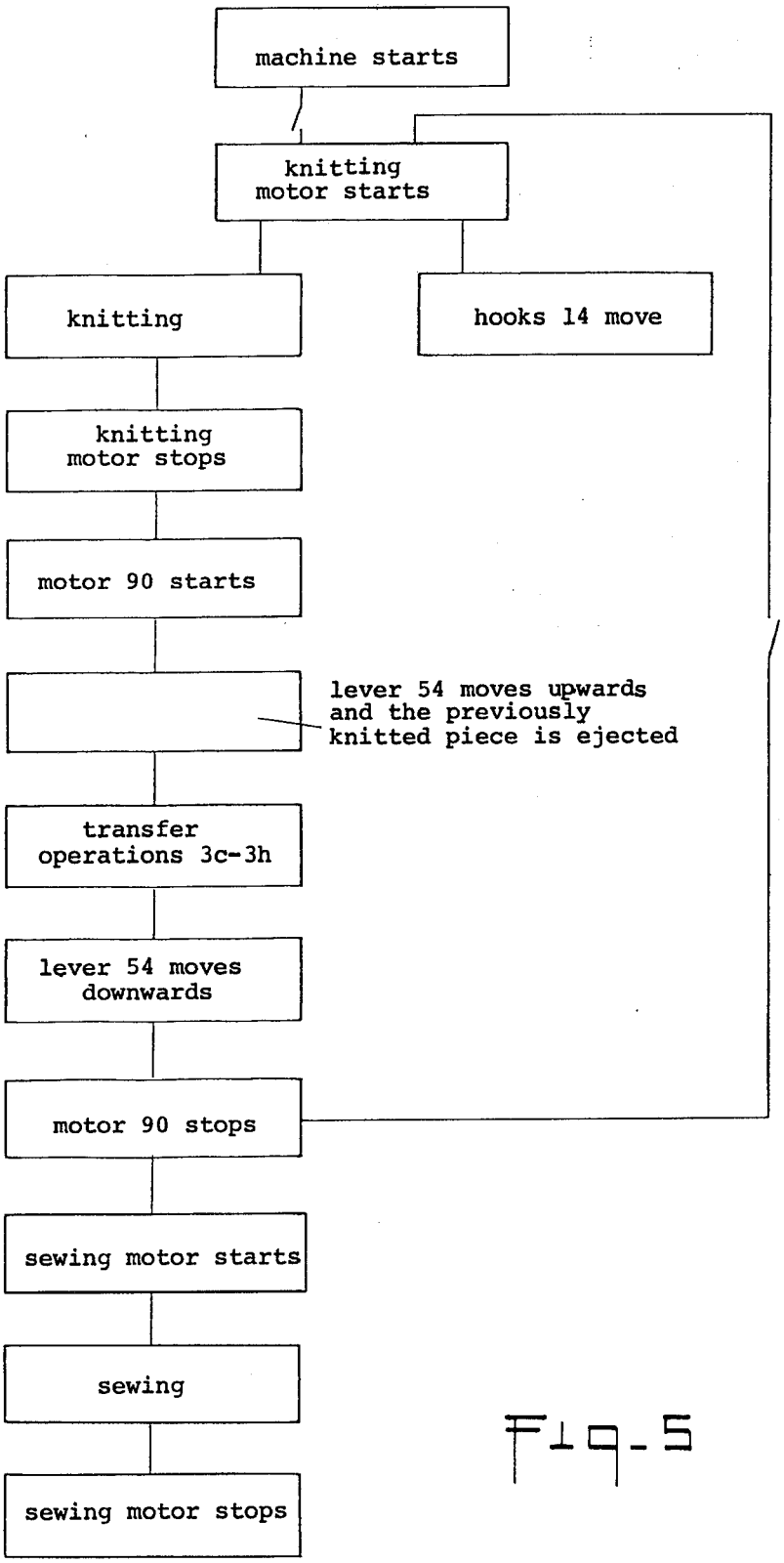

The working of the machine is schematized in FIG. 5 and is explained hereafter.

At the start of the knitting operation illustrated in FIGS. 3*a* to 3*i*, the arm 54 is in the low position shown in dotted line in FIG. 6, the cam follower 57 being on a surface of small radius of the cam 59 (which has not been specified in FIG. 6) and the said cam being stationary since the motor 90 is stopped.

The motor of the knitting part, on the contrary, is working: the thread-guide 91 supported by the cam-carriage 92, effects a first run, starting from a predetermined position situated outside the needle bed: the thread 3 (FIG. 2*a*) is then placed in the hook of the knitting needles 2 which, by their retracting movement, create a "network" of which each loop 3*a* surrounds the hook of a needle 2.

Figure 7:
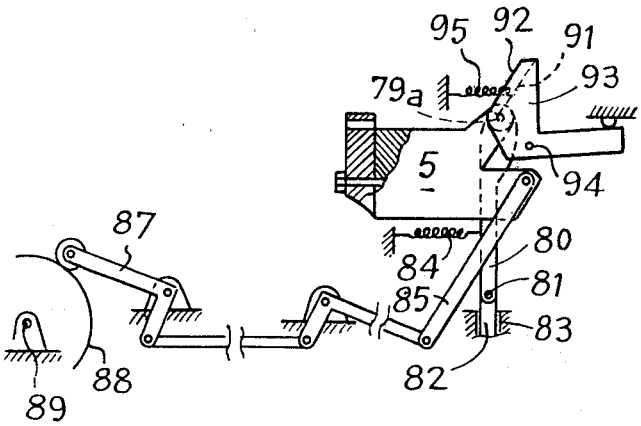
FIG. 7 shows in detail the mechanism of the movement of the hook bars of FIG. 6.
Figure 8:
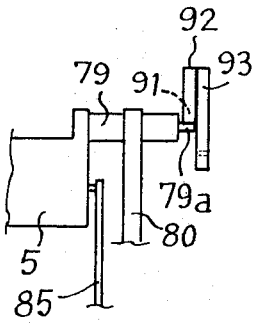
FIG. 8 is a side view of the detail of FIG. 7.
Figure 9:
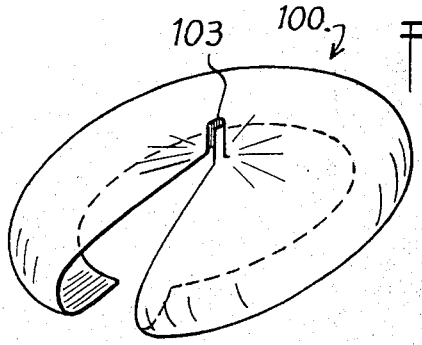
FIGS. 9 and 10 show a beret before and after sewing.
Figure 10:
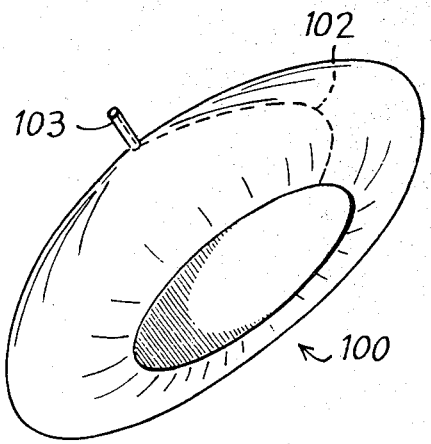

FIGS. 7 and 8 show in more details the mechanisms allowing the complex movement of the bar 5 (referred to as "the bar with hooks").

The axle 79 of the bar with hooks ends in a stud 79*a* made of hardened steel, which is adapted to slide over the ramps 91 and 92 of a part 93 hinged in 94 and returned to a rest position by a return spring 95.

The latch needles 14 then perform a pivoting and ascending movement under the thrusting action of the rotation cam 88 and of the elevation cam not shown: starting from the position they are in on FIG. 6, they begin to pivot (their hook 14*a* remaining at the same height since it coincides with the pivoting axle 79 of the bar with hooks 5) until they are almost vertical; they ascend then, the stud 79*a* sliding over the ramp 91, which procures a retracting movement of the bar with hooks 5, the purpose of which being to move the needles 14 away from the "network" formed by the first run of the thread-guide.

With another rotation followed by a slight ascending movement, the latch needles are placed in a vertical position, above the thread 3, at the moment when the stud 79*a* has left the ramp 91 and the arm 80 has been returned to a vertical position by the spring 84.

A reversed pivoting movement combined with a descending movement permits to hook the thread 3 by vertical descent, the sinkers 1 descending also at the same moment, then they return gradually to their initial position whereas the thread-guide starts on its second run. In order to avoid pulling the knitting, the reentering of the latch needles is effected over two runs of the thread-guide, said latch needles only descending the height of a knitted stitch at each run.

On the second run of the thread-guide 91, the end of the latch needle is surrounded by a loop as indicated in FIG. 3*b*.

The first row of loops being retained on the hooks of the latch needles 14, the knitting of the article continues in accordance with a pre-set program, the knitting obtained forming a fold the inside of which is the right side of a stocking stitch knitting.

This is essential for the invention and the position of the latch needles has precisely been chosen to oblige the knitting to fold finish side on finish side during the knitting operation. This position is necessary to allow accurate sewing of the two edges assembled stitch by stitch.

At the end of the last of the programmed rows, the thread-guide 91 stops in exactly the same position that it occupied at the start of the article. This stoppage of the thread-guide and of all the knitting functions is controlled by a programmer which is also designed to start the motor 90.

Said motor 90 will drive the cams 59, 71, 71*a*, 77 for a complete rotation.

The cam 59 is of predetermined outline in order to allow the arm 54 to move from its low position shown in dotted lines, to its high position, shown in block lines in FIG. 6, where it is held by a cylinder-shaped part of cam the time needed to carry out the operations 3*c*–3*h*.

The axle 53 is in fact extended at its ends and comes into abutment on cradles not shown, this locking the bell crank lever in position for the whole time during which the cam 59 is on its cylinder-shaped part.

The ascending and descending movements of the bars with points and of the counter-sinkers are controlled by the adapted outline of the cam 77, whereas the forward and backward movements of the points 15 are controlled by the cam 71, and those of the counter-sinkers 17 by the cam 71*a*.

When the knitted article has reached the level of the operation illustrated in FIG. 3*h*, its outmost rows are fixed loop by loop on the points 15.

When completing its rotation, the cam 59 sends back the arm 54 to its lower sewing position (in dotted lines), the effect of which being to stop the motor 90, by appropriate switching means, and to start the motor (not shown) of the sewing machine represented as 19. The said motor actuates a sewing device similar to those conventionally used in looping machines. The said motor stops immediately the sewing has been effected over the whole length of the article, the knitting thread which joins the sewn article to the article being knitted being cut by a chisel just before the motor stops.

Said article will be ejected from the points 15 when a new article is knitted and when the arms 216 start their ascending movement.

Thus in the method according to the present invention the loop heads of at least one of the ends of the knitted piece are retained on the knitting needles whilst the loop heads of the other end edge are retained by any suitable means and especially by the use of auxiliary supports such as the hooks 4 or the latch needles 14. This method enables the automation of the finishing operation of the article by sewing the corresponding loops on the two ends together. This method is applicable to knitted articles with true or false decrease, the only requirement on the article to enable the present invention to be used is that each of the ends of the knitted piece which are to be sewn together have an equal number of loop heads, that is to say, an equal number of free nonconnected loops.

Thus in accordance with the principle of the invention both end edges of the knitted piece are retained on supports once they have been formed and are transferred directly to a common support and thence to a sewing machine without any manual handling step.

What is claimed is:

1. In a method of manufacturing a hollow knitted article including knitting a flat piece having opposite ends by using at least some of the needles in one bed of a flat bed knitting machine, said ends containing an equal number of knit loops, and then seaming the corresponding loops of said ends together by sewing, the improvement comprising:

knitting a first row of loops to forme one end of said piece;

transferring said first row of loops onto the points of a first support located underneath and substantially in vertical alignment with the front end of said needles in said needle bed in their knocking over position, said first support having a number of points equal to the number of loops in said first row;

continuing the knitting of said piece until a row of loops forming the other end is completed while keeping said first row of loops on the points of said first support adjacent said needles to cause said piece to fold while being knit with its finished side on the inside; and upon completion of knitting of said piece, transferring the loops from said other end onto a second support having points arranged to retain loops from both said ends;

transferring the first row loops from the points of the first support to corresponding points of the second support;

bringing the corresponding loops of said ends adjacent each other on the points of said second support;

and, joining said corresponding loops together on the points of said second support by sewing while the finished sides of the piece lie between the ends of the article facing each other.

2. The method according to claim 1, wherein said first knitted piece is weft knitted and wherein said first row of loops is formed and transferred to said points of the first support by seizing and retaining loops of yarn formed between said needles of said needle bed after said loops are knit by using said points of said first support, said points retaining loops in said position while said first row is completed.

3. The method according to claim 2, wherein the seizing and retaining of the loops is carried out by using hooks on the ends of the points of said first support.

4. The method according to claim 3 wherein the points of said first support are pivoted about an axis extending along and below the needle bed while they are moved towards and away from the needle bed to seize and retain the loops of the first knit row.

5. The method according to claim 1, wherein the first support to which said first row of loops forming said first row are transferred comprise a first temporary support and the second support to which said loops forming said other end are transferred comprises a second common support, said loops forming said other end being first transferred temporarily to the points of said temporary support and then to corresponding points of said common support with the first row loops to bring the corresponding loops together for sewing.

6. The method according to claim 1 wherein the end row loops of one piece are sewn together on the knitting machine while the next piece is being knitted.

7. In a knitting machine for forming hollow knit articles from flat knit pieces having opposite ends to be seamed by sewing and including a flat needle bed with knitting needles, means to periodically advance and retract said needles to carry out a knitting operation, means to lay yarn or thread over said needles as required to form said knit articles, a machine motion control means, the improvement comprising:

a first support including a set of hooked points arranged adjacent and beneath said needle bed, said hooked points being equal in number to the number of loops formed by the knitting needles that are to be joined by sewing and being laterally offset from the needles along the needle bed so they lie intermediate the needles;

means for moving the hooked points vertically towards and away from the knitting needles in synchronism with the motion of the machine;

a second support means adjacent the needle bed including points corresponding in number to the number of loops formed by the knitting machine to be jointed by sewing;

means for moving said points of said second support means towards and away from the hooked points of said first support means in synchronism with the motion of the machine;

means for transferring the loops of the first knit row of said articles to the hooked ends of said first support means and causing said loops to be retained closely adjacent said needle bed;

means for transferring the loops of the last knit row of said articles to the points of said second support and causing the last recited loops to be retained adjacent said needle bed;

means for transferring the loops of said first support to said second support with loops to be sewn together disposed on a common point of said second support;

and a sewing station forming part of the knitting machine;

means for preventing the loop pairs to be sewn together to said sewing station while they are retained on said second support.

8. A knitting machine according to claim 7 wherein said knitting needles and hooked points are identical latch type needles.

9. A knitting machine according to claim 7 wherein said needles are the latch type needle, and said points of said second support have elongated apertures at their free ends, said apertures having widths and lengths greater than the widths and lengths of the hooks of said needles; each of said points including a grooved section behind its respective aperture, the profile of the grooved section being geometrically suitable to enable the passage of the sewing needle of said automatic sewing means between a knit loop retained on said point and the body of the point.

* * * * *